US010655269B2

(12) United States Patent
Uim et al.

(10) Patent No.: US 10,655,269 B2
(45) Date of Patent: May 19, 2020

(54) WASHING MACHINE

(71) Applicant: Samsung Electronics Co., Ltd, Suwon-si (KR)

(72) Inventors: Dong Hyuk Uim, Seoul (KR); Jae Won Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 142 days.

(21) Appl. No.: 15/752,535

(22) PCT Filed: Aug. 9, 2016

(86) PCT No.: PCT/KR2016/008743
§ 371 (c)(1),
(2) Date: Feb. 13, 2018

(87) PCT Pub. No.: WO2017/026770
PCT Pub. Date: Feb. 16, 2017

(65) Prior Publication Data

US 2019/0010657 A1 Jan. 10, 2019

(30) Foreign Application Priority Data

Aug. 13, 2015 (KR) ..... 10-2015-0114258

(51) Int. Cl.
*D06F 37/10* (2006.01)
*D06F 39/14* (2006.01)
(Continued)

(52) U.S. Cl.
CPC ..... *D06F 39/14* (2013.01); *D06F 37/28* (2013.01); *D06F 37/42* (2013.01); *D06F 39/083* (2013.01);
(Continued)

(58) Field of Classification Search
CPC ..... D06F 37/10
See application file for complete search history.

(56) References Cited

U.S. PATENT DOCUMENTS 5,546,772 A * 8/1996 Merlin ..... D06F 37/10 68/142
7,313,932 B2 1/2008 Ryohke et al.
(Continued)

FOREIGN PATENT DOCUMENTS

CN 2397157 Y 9/2000
CN 201268792 Y 7/2009
(Continued)

OTHER PUBLICATIONS

International Search Report dated Oct. 26, 2016 in connection with International Patent Application No. PCT/KR2016/008743.
(Continued)

*Primary Examiner* — Jason Y Ko

(57) ABSTRACT

Disclosed is a washing machine including a main body, a main washing unit provided inside the main body, and a door unit for opening and closing a main entrance formed in the main body to approach the main washing unit. The door unit includes a main door and an auxiliary door. The main door includes an auxiliary washing unit, an auxiliary entrance for inputting laundry into the auxiliary washing unit, and an opening through which the contents of the auxiliary washing unit are discharged. The auxiliary door is rotatably coupled to the main door to open and close the auxiliary entrance. When the auxiliary door is opened, the auxiliary door closes the opening to form an auxiliary washing space in which water is able to be contained. When the auxiliary door is closed after the hand-washing, the opening is opened to discharge the laundry and the washing water in the auxiliary laundry space to the main washing unit naturally.

14 Claims, 17 Drawing Sheets

(51) Int. Cl.

| | |
|---|---|
| ***D06F 37/42*** | (2006.01) |
| ***D06F 37/28*** | (2006.01) |
| ***D06F 39/08*** | (2006.01) |
| *D06F 3/00* | (2006.01) |
| *D06F 31/00* | (2006.01) |

(52) U.S. Cl.
CPC ..... *D06F 3/00* (2013.01); *D06F 31/00* (2013.01); *D06F 2224/00* (2013.01)

(56) References Cited

U.S. PATENT DOCUMENTS

| | | | | |
|---|---|---|---|---|
| 9,200,399 | B2 | 12/2015 | Kim et al. | |
| 9,315,934 | B2 | 4/2016 | Kim et al. | |
| 2005/0072194 | A1 | 4/2005 | Ryohke et al. | |
| 2015/0275413 | A1* | 10/2015 | Kim | D06F 37/18 68/27 |

FOREIGN PATENT DOCUMENTS

| | | | |
|---|---|---|---|
| CN | 103437131 | A | 12/2013 |
| CN | 204091799 | U | 1/2015 |
| JP | 58-008484 | U | 1/1983 |
| JP | 2002-273092 | A | 9/2002 |
| KR | 10-1999-0016037 | A | 3/1999 |
| KR | 20-2013-0001857 | U | 3/2013 |
| KR | 10-1543566 | B1 | 8/2015 |
| WO | 2015/115730 | A1 | 8/2015 |
| WO | WO-2015130046 | A1 * | 9/2015 |

OTHER PUBLICATIONS

Written Opinion of the International Searching Authority dated Oct. 26, 2016 in connection with International Patent Application No. PCT/KR2016/008743.

Office Action dated Dec. 31, 2019 in connection with Chinese Patent Application No. 201680035478.5, 9 pages.

* cited by examiner

WASHING MACHINE

CROSS-REFERENCE TO RELATED APPLICATION(S)

The present application is a 371 National Stage of International Patent Application No. PCT/KR2016/008743 filed Aug. 9, 2016 which claims priority to Korean Patent Application No. 10-2015-0114258 filed Aug. 13, 2015, which are incorporated herein by reference into the present disclosure as if fully set forth herein.

TECHNICAL FIELD

The present disclosure relates to a washing machine, and more particularly, to a washing machine including an auxiliary washing unit to enable a user to pre-wash laundry with his/her hands.

BACKGROUND

A washing machine is a home appliance for washing clothes by use of electricity. In general, the washing machine includes a tub to store water, a rotation drum rotatably installed in the inside of the tub, and a driving apparatus to rotate the rotation drum.

The washing machine can be classified into an agitator type washing machine, a pulsator type washing machine, and a drum type washing machine according to washing methods. The agitator type washing machine washes laundry by rotating a washing impeller standing in the center of a tub in the left and right directions. The pulsator type washing machine washes laundry by streams of water generated by rotating a pulsator in the shape of a disk mounted on the bottom of a rotation drum in the left and right directions. The drum type washing machine washes laundry by lifting and dropping the laundry through lifters formed on the inner circumferential surface of a drum.

However, there are many cases that ingrained stains, spots, etc. are not removed by mechanical washing as described above. Accordingly, a washing machine having an auxiliary washing unit has been developed to enable a user to pre-wash laundry with his/her hands before mechanical washing. The auxiliary washing unit is disposed generally between a door and a main body. Accordingly, a user who wants to hand-wash laundry performs a series of operations of opening the door to hand-wash the laundry in the auxiliary washing unit, rotating the auxiliary washing unit to discharge the laundry, etc. contained in the auxiliary washing unit to the inside of the main body, then again rotating the auxiliary washing unit to its original position, and closing the door.

An aspect of the present disclosure is to provide a washing machine capable of simplifying a series of operations for hand-washing.

Another aspect of the present disclosure is to provide a washing machine capable of performing hand-washing without having to open a main door.

Another aspect of the present disclosure is to provide a washing machine capable of reducing manufacturing cost of a door unit.

SUMMARY

In accordance with an aspect of the present disclosure, there is provided a washing machine including a main body; a main washing unit disposed in the inside of the main body;

and a door unit configured to open or close a main entrance formed in the main body to communicate with the main washing unit, wherein the door unit includes a main door having a body unit formed with an auxiliary entrance, and an auxiliary washing unit formed to be recessed from the body unit and having an opening; and an auxiliary door rotatably coupled with the main door, and configured to open or close the auxiliary entrance, and if the auxiliary door opens, the auxiliary door closes the opening to form an auxiliary washing space in which water is able to be contained.

If the auxiliary door is closed, the opening opens so that the water contained in the auxiliary washing space is discharged to the main washing unit through the opening.

The auxiliary door may rotate between a first position to close the auxiliary entrance and a second position to close the opening.

The auxiliary door may include a filler portion configured to close the opening.

The filler portion may located behind a rotation shaft of the auxiliary door.

The opening may be disposed behind the auxiliary washing unit.

The auxiliary entrance and the opening may be located on different planes.

The auxiliary door may be accommodated in the auxiliary entrance when the auxiliary door is in a closed state.

The door unit may include a sealing member configured to seal between the auxiliary door and the opening when the auxiliary door is in an open state.

The sealing member may be disposed in the auxiliary door.

The door unit may include a first locking apparatus configured to fix the auxiliary door when the auxiliary door is in an open state.

The first locking apparatus may include a hook member configured to be rotatable, and an elastic member configured to elastically support the hook member.

The door unit may include a second locking apparatus configured to fix the auxiliary door when the auxiliary door is in a closed state.

If the auxiliary door is pushed, the second locking apparatus is unlocked.

The main door may include a support flange disposed at edges of the auxiliary entrance, and configured to support the auxiliary door when the auxiliary door is in a closed state.

According to the technical concepts of the present disclosure, a series of operations for hand-washing can be simplified.

According to the technical concepts of the present disclosure, since a user only has to open an auxiliary door having a relatively small size without having to open a main door in order to hand-wash laundry, the user can use an auxiliary washing unit with a relatively small force, and also can add laundry even while mechanical washing is being performed.

According to the technical concepts of the present disclosure, it is possible to reduce manufacturing cost of a door unit.

According to the technical concepts of the present disclosure, a user can see the auxiliary door even when the main door is in a closed state.

DETAILED DESCRIPTION

Figure 1:
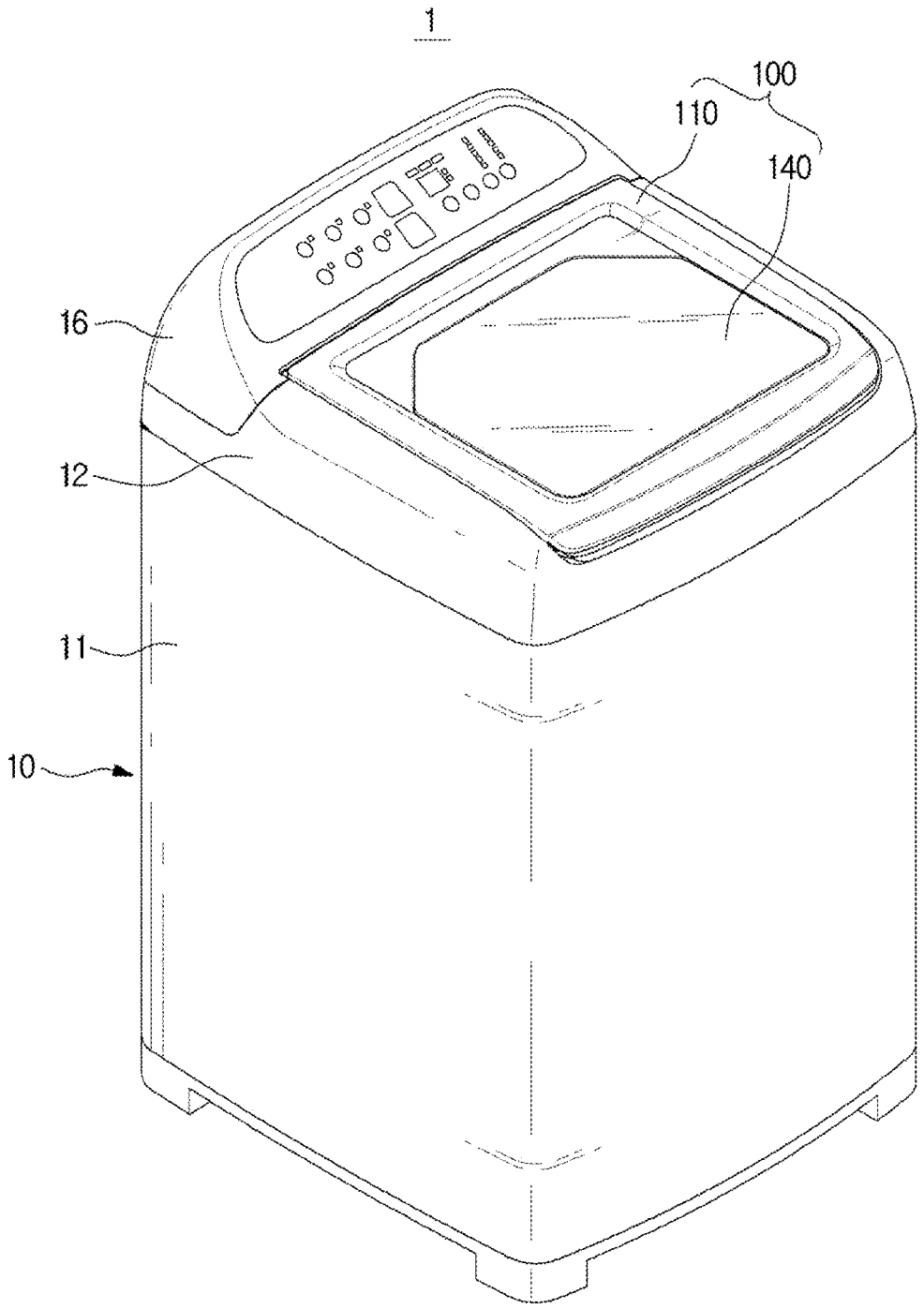
FIG. 1 is a perspective view showing an outer appearance of a washing machine according to an embodiment of the present disclosure.

The embodiments described in the present specification are only the preferred embodiments of the present disclosure, and thus it is to be understood that various modified examples, which may replace the embodiments described in the present specification, are possible when filing the present application.

In the drawings, like reference numerals represent like components, and also, for easy understanding, the sizes of components are more or less exaggeratedly shown.

Unless otherwise defined, all terms (including technical and scientific terms) used herein have the same meaning as commonly understood by one of ordinary skill in the art to which this invention belongs.

It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that, although the terms first, second, etc. may be used herein to describe various components, these components should not be limited by these terms. For example, the terms do not limit the order and/or importance of the components. These terms are only used to distinguish one component from another.

As used herein, the singular forms "a", "an" and "the" are intended to include the plural forms as well, unless the context clearly indicates otherwise.

It will be further understood that the terms "comprises" or "has", when used herein, specify the presence of stated features, integers, steps, operations, elements, components and/or groups thereof, but do not preclude the presence or addition of one or more other features, integers, steps, operations, elements, components, and/or groups thereof.

Also, the expressions "in front of", "behind", "above", "below", "to the left of", or "to the right of" indicate cases that a certain component is located "in front of", "behind", "above", "below", "to the left of" or "to the right of" another component, but do not exclude cases that another component is positioned between these components.

Hereinafter, the preferred embodiments of the present disclosure will be described in detail with reference to the accompanying drawings.

Figure 2:
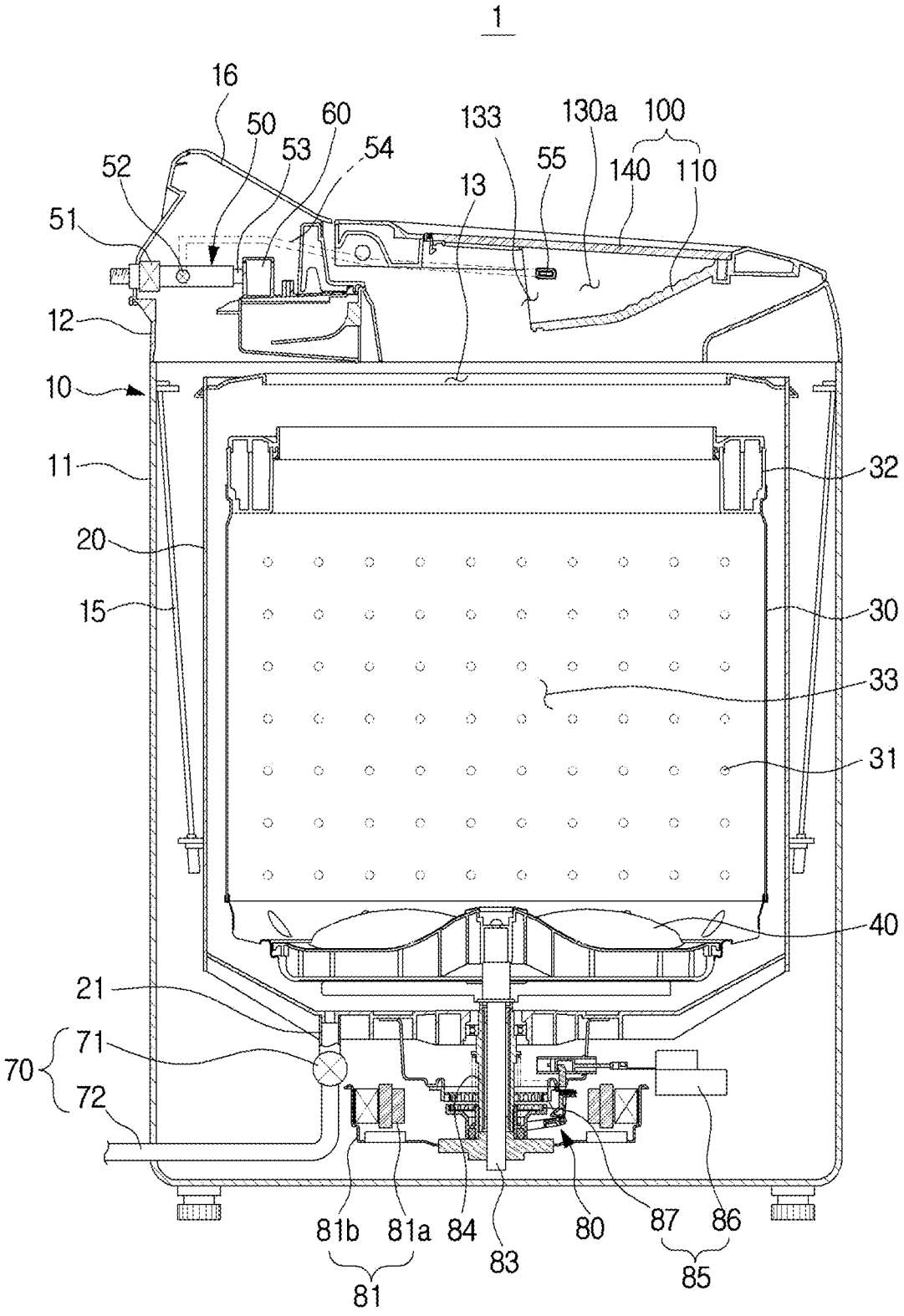
FIG. 2 is a schematic cross-sectional view of the washing machine of FIG. 1.
Figure 3:
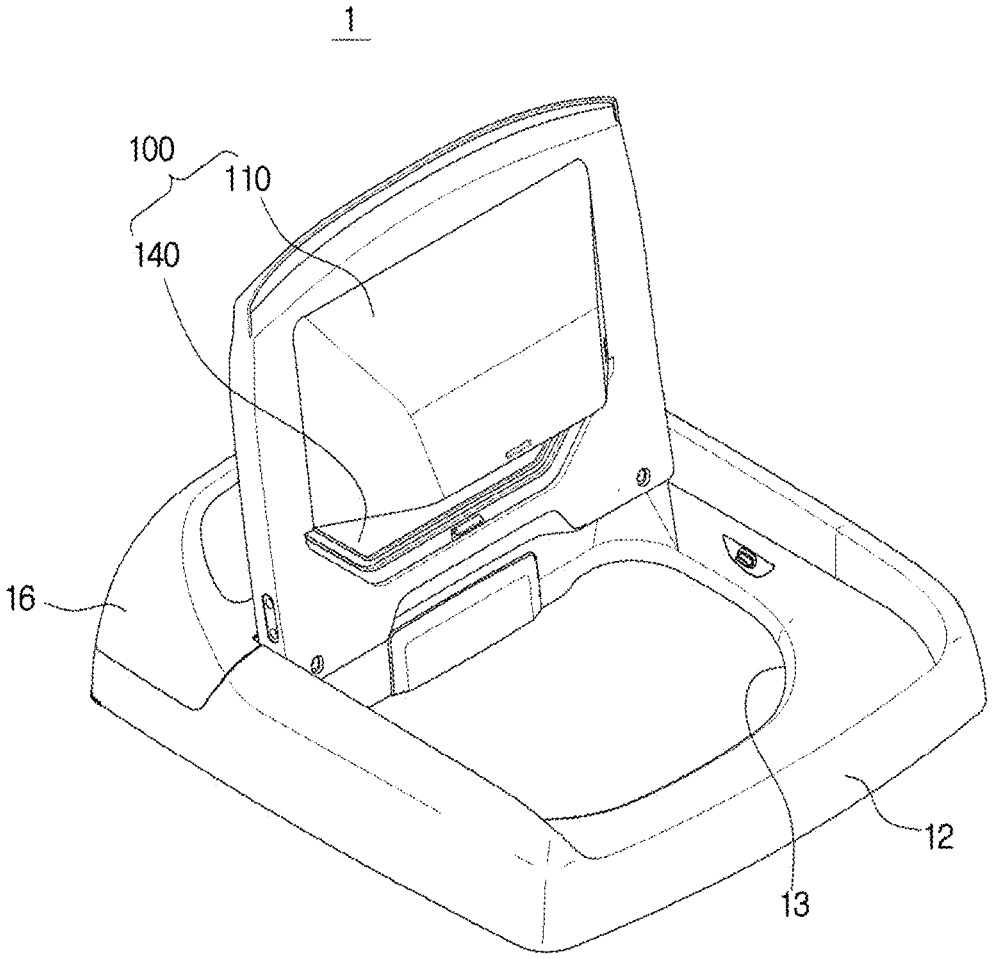
FIG. 3 shows a state in which a main door of the washing machine of FIG. 1 opens.
Figure 4:
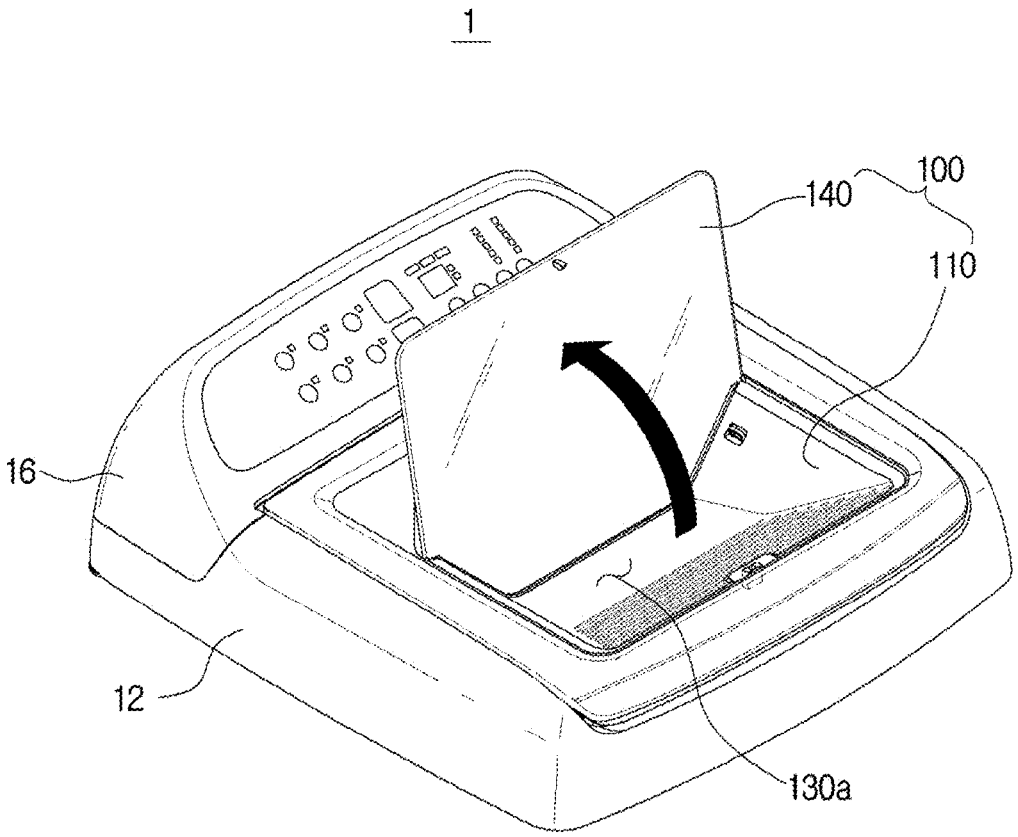
FIG. 4 shows a state in which an auxiliary door of the washing machine of FIG. 1 opens.
Figure 5:
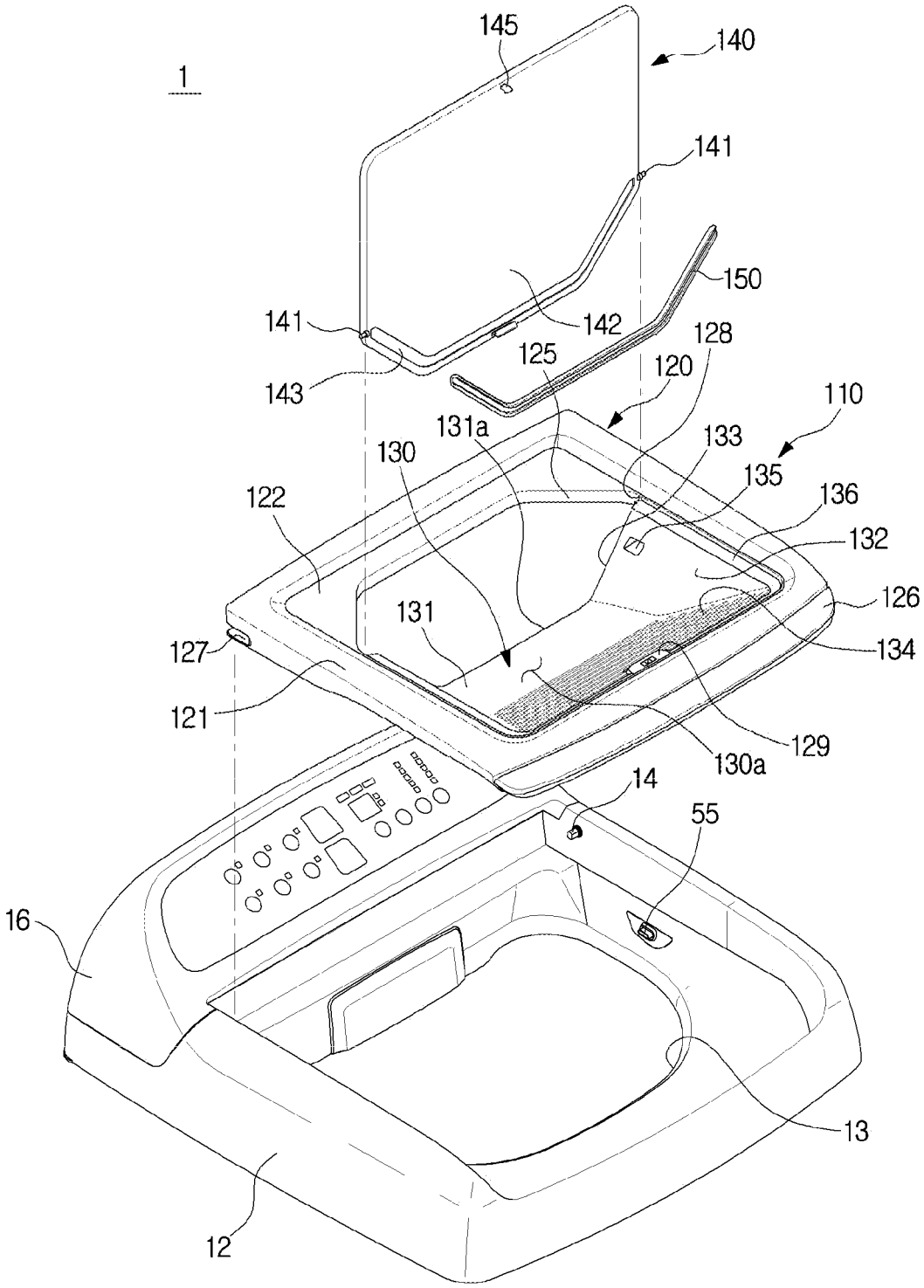
FIG. 5 is an exploded perspective view of a door unit of the washing machine of FIG. 1.
Figure 6:
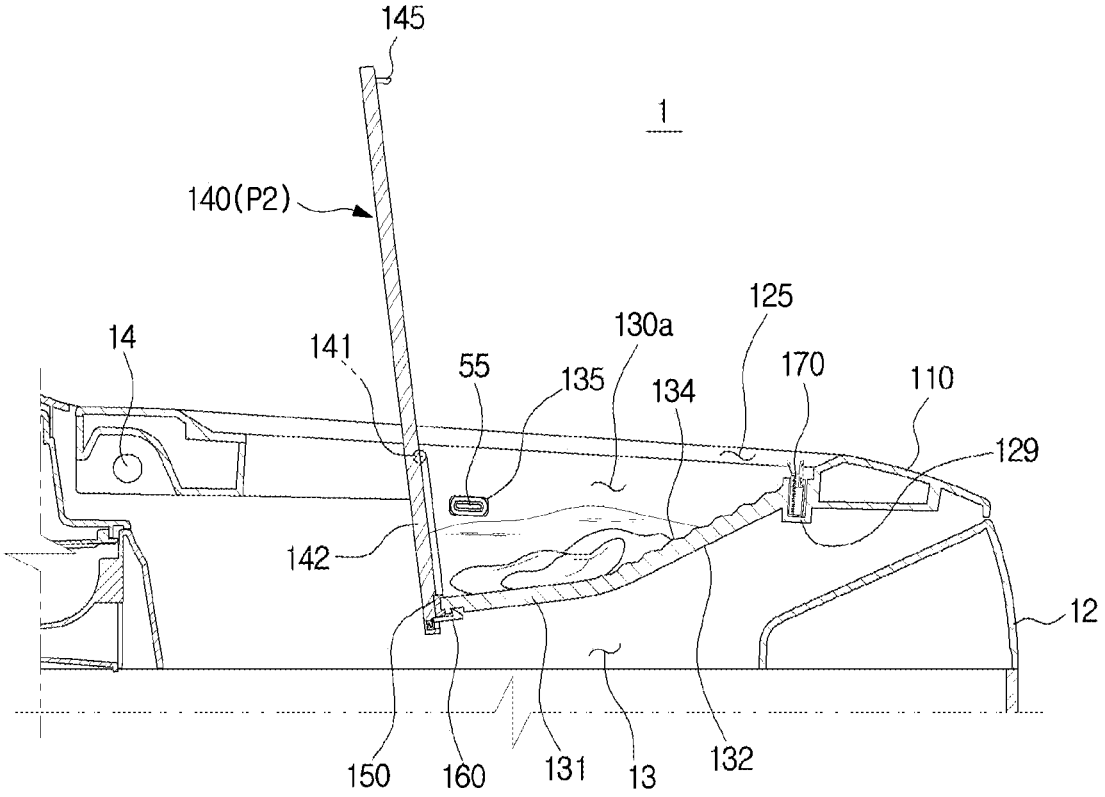
FIG. 6 is a cross-sectional view showing a state in which the auxiliary door of the washing machine of FIG. 1 opens fully.
Figure 7:
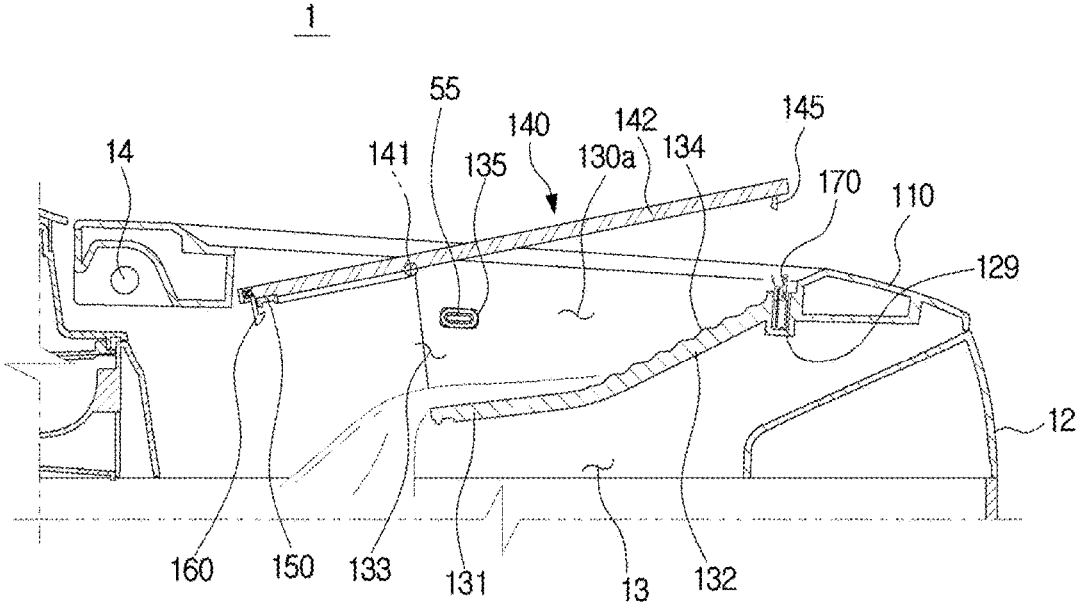
FIG. 7 is a cross-sectional view showing a state in which the auxiliary door of the washing machine of FIG. 1 opens partially.
Figure 8:
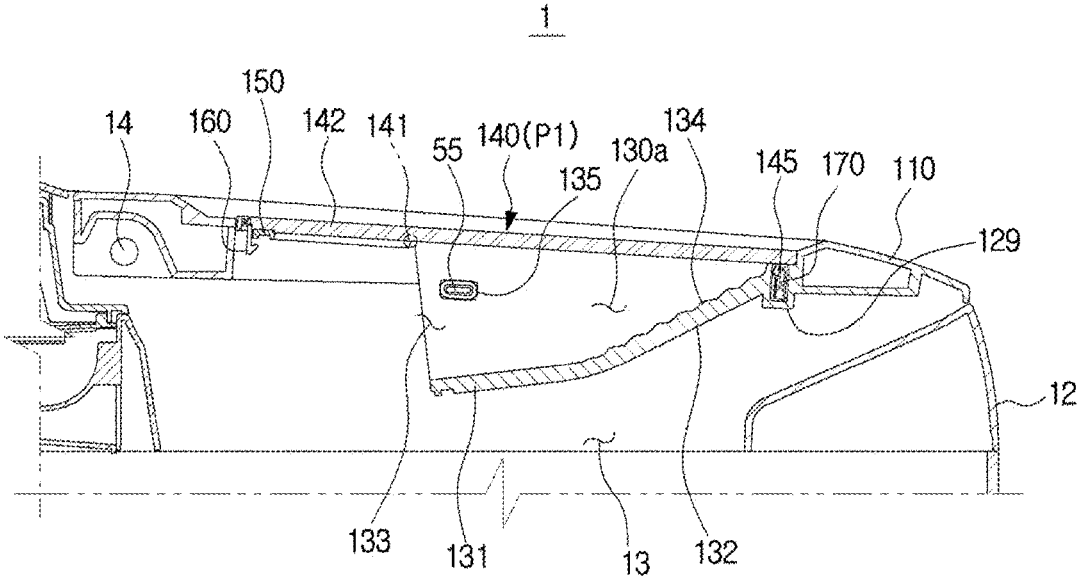
FIG. 8 is a cross-sectional view showing a state in which the auxiliary door of the washing machine of FIG. 1 is closed.
Figure 9:
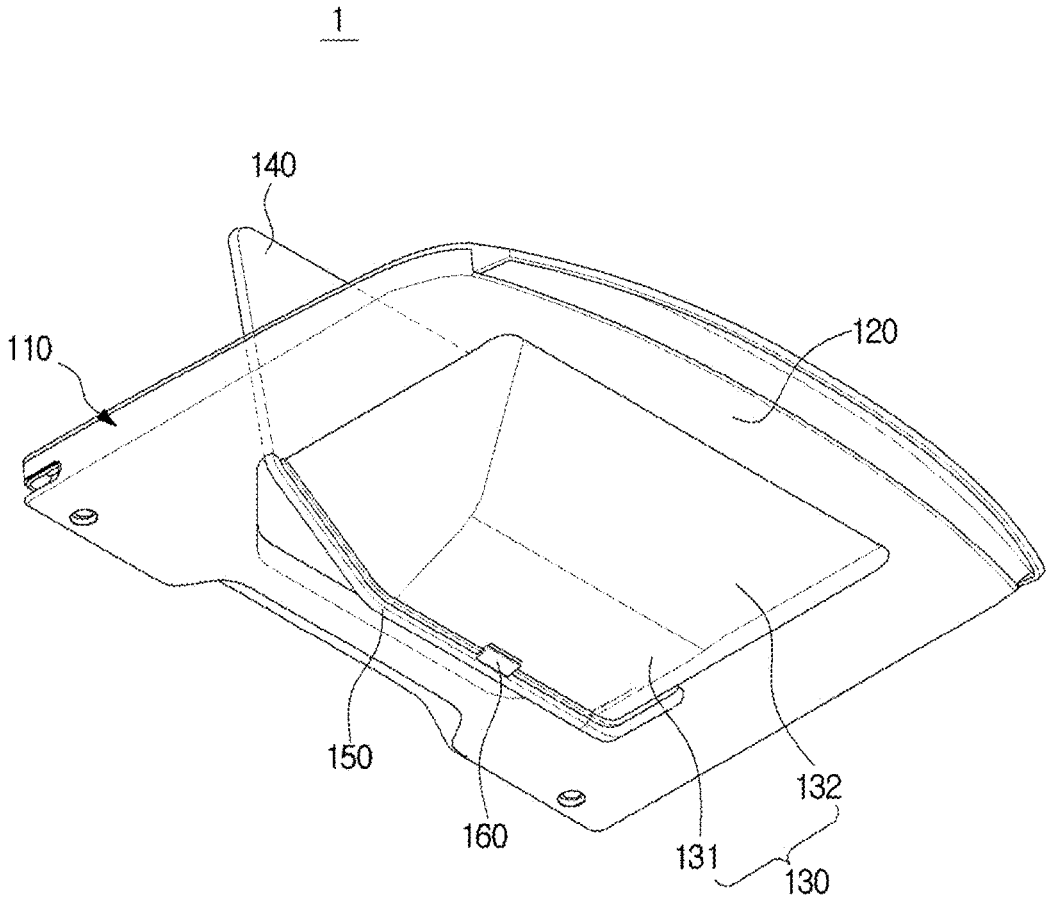
FIG. 9 is a perspective view showing a bottom of the door unit of the washing machine of FIG. 1.

FIG. 1 is a perspective view showing an outer appearance of a washing machine according to an embodiment of the present disclosure. FIG. 2 is a schematic cross-sectional view of the washing machine of FIG. 1. FIG. 3 shows a state in which a main door of the washing machine of FIG. 1 opens. FIG. 4 shows a state in which an auxiliary door of the washing machine of FIG. 1 opens. FIG. 5 is an exploded perspective view of a door unit of the washing machine of FIG. 1. FIG. 6 is a cross-sectional view showing a state in which the auxiliary door of the washing machine of FIG. 1 opens fully. FIG. 7 is a cross-sectional view showing a state in which the auxiliary door of the washing machine of FIG. 1 opens partially. FIG. 8 is a cross-sectional view showing a state in which the auxiliary door of the washing machine of FIG. 1 is closed. FIG. 9 is a perspective view showing a bottom of the door unit of the washing machine of FIG. 1.

Hereinafter, a washing machine according to an embodiment of the present disclosure will be described with reference to FIGS. 1 to 9.

A washing machine 1 may be a pulsator type washing machine as a top loading type in which a user can put laundry from above, and which generates streams of water through a pulsator 40 to wash laundry. However, the technical concepts of the present disclosure can be applied to an agitator type washing machine and a drum type washing machine.

The washing machine 1 may include a main body 10, and a main washing unit installed in the inside of the main body 10. The main washing unit may include a tub 20 to store washing water, and a rotation drum 30 rotatably disposed in the inside of the tub 20, and accommodating laundry.

The main body 10 may include a cabinet 11 in the shape of a box, and a top cover 12 coupled with a upper portion of the cabinet 11. In the top cover 12, a main entrance 13 through which laundry can be put into the inside of the rotation drum 30 may be formed. In a rear portion of the top cover 12, a control panel 16 may be disposed to display various operation information of the washing machine 1 or to receive various operation commands.

The tub 20 may be in the shape of a cylinder whose upper portion opens. The tub 20 may be supported by a suspension apparatus 15. According to another embodiment, the washing machine 1 may include only the rotation drum 30 without including the tub 20.

In a bottom of the tub 20, a drain 21 may be disposed to discharge washing water stored in the tub 20 to the outside of the main body 10.

The rotation drum 30 may be rotatably disposed in the inside of the tub 20 to accommodate laundry. The rotation drum 30 may be in the shape of a cylinder whose upper portion opens, and a main washing space 33 may be formed in the inside of the rotation drum 30. In a circumferential side portion of the rotation drum 30, a plurality of through holes 31 may be formed to pass washing water through. In the upper portion of the rotation drum 30, a balancer 32 may be disposed to remove a weight imbalance occurring when the rotation drum 30 rotates.

On the bottom of the rotation drum 30, a pulsator 40 may be rotatably installed in the shape of a disk. The pulsator 40 may generate streams of water for washing.

The washing machine 1 may include a water-supply apparatus 50 to supply washing water to the inside of the tub 20.

The water-supply apparatus 50 may include a water-supply valve 51 to control supply of water, a main water-supply pipe 53 to supply washing water to the main washing space 33, an auxiliary water-supply pipe 54 to supply washing water to an auxiliary washing space 130*a* which will be described later, and a switch apparatus 52 to switch a water path to guide washing water supplied from an external water-supply source selectively to the main water-supply pipe 53 or the auxiliary water-supply pipe 54.

The main water-supply pipe 53 may be connected to a detergent supply apparatus 60 so that washing water can be supplied together with detergents to the main washing space 33.

The washing machine 1 may include a drain apparatus 70 to discharge washing water in the inside of the tub 20 to the outside of the main body 10.

The drain apparatus 70 may include a drain pipe 72 connected to the drain 21 of the tub 20, and a drain valve 71 or a drain pump to open or close the drain pipe 72.

The washing machine 1 may include a driving apparatus 80 for rotating the rotation drum 30 and the pulsator 40.

The driving apparatus 80 may include a motor 81 to convert an electrical force to mechanical torque, a hollow dehydration shaft 84 to transfer a driving force generated by the motor 81 to the rotation drum 30, a washing shaft 83 installed in a hollow space of the dehydration shaft 84 to transfer a driving force of the motor 81 to the pulsator 40, and a clutch apparatus 85 connecting/disconnecting the motor 81 to/from the dehydration shaft 84.

The motor 81 may include a stator 81*a*, and a rotor 81*b* rotating by electromagnetically interacting with the stator 81*a*. The washing shaft 83 may be pressed in the rotor 81*b* so that the washing shaft 83 may rotate together with the rotor 81*b*.

The clutch apparatus 85 may include a coupling 87 configured to rise or fall to connect/disconnect the dehydration shaft 84 to/from the rotor 81*b*, and an actuator 86 to provide a driving force for raising or lowering the coupling 87.

Through the structure, the washing machine 1 may rotate only the pulsator 40 to generate rotating streams of water so that laundry rotates by the rotating streams of water to rub against the rotation drum 30, thereby performing a washing course. Also, the washing machine 1 may rotate the pulsator 40 and the rotation drum 30 together so that water of laundry is removed through the through holes 31 by a centrifugal force, thereby performing a dehydration course.

The washing machine 1 may include a door unit 100 to open or close a main entrance 13 of the main body 10.

The door unit 100 may be rotatably coupled with the main body 10. In order to rotatably couple the door unit 100 with the main body 10, the main body 10 may include a main rotation shaft 14 (see FIG. 5), and a main rotation shaft accommodating groove 127 (see FIG. 5) may be formed in a main door 110 (will be described later) of the door unit 100 such that the main rotation shaft 14 is rotatably inserted into and supported on the main rotation shaft accommodating groove 127.

The door unit 100 may include the main door 110 and an auxiliary door 140.

The auxiliary door 140 may be rotatably coupled with the main door 110. In order to rotatably couple the auxiliary door 140 with the main door 110, the auxiliary door 140 may include an auxiliary rotation shaft 141, and an auxiliary rotation shaft accommodating groove 128 may be formed in the main door 110 such that the auxiliary rotation shaft 141 is rotatably inserted into and supported on the auxiliary rotation shaft accommodating groove 128.

The main door 110 may include a body unit 120, an auxiliary washing unit 130, an auxiliary entrance 125, and an opening 133.

The body unit 120 may include a frame portion 121, and a door member 122 disposed in the inside of the frame portion 121. The frame portion 121 may surround front, rear, left, and right portions of the door member 122, and support the door member 122. The door member 122 may be made of a transparent material to enable a user to see the inside.

However, unlike the current embodiment, the frame portion 121 and the door member 122 may be integrated into one body.

In a front part of the body unit 120, a handle 126 may be disposed to open or close the main door 110.

The auxiliary washing unit 130 may be disposed below the body unit 120. The auxiliary washing unit 130 may have a depressed shape.

The auxiliary washing unit 130 may include a bottom part 131, and a side part 132 inclined toward the bottom part 131.

On the bottom part 131 or the side part 132, a plurality of washing protrusions 134 may be formed to enable the user to rub laundry to wash it. The washing protrusions 134 may have various shapes.

In the auxiliary washing unit 130, a washing water inlet 135 into which an auxiliary water-supply opening 55 for supplying water to the main washing space 33 of the main body 10 is inserted may be formed.

The auxiliary entrance 125 may be formed on an upper surface of the auxiliary washing unit 130. The auxiliary entrance 125 may be formed in the door member 122 of the main door 110.

The user may put laundry into the auxiliary washing unit 130 through the auxiliary entrance 125, or put his/her hands into the auxiliary washing unit 130 through the auxiliary entrance 125 to hand-wash the laundry.

The opening 133 may extend upward from the lowermost edge 131*a* of the bottom part 131, and the bottom part 131 and the side part 132 may be inclined downward toward the opening 133. The opening 133 may be located on a different plane from the auxiliary entrance 125. The opening 133 may be disposed behind the auxiliary washing unit 130. The opening 133 may have a sufficient size to discharge laundry as well as washing water.

If the auxiliary door 140 which will be described opens, the auxiliary door 140 may close the opening 133 to form the auxiliary washing space 130*a* in which water can be contained by the auxiliary washing unit 130 and the auxiliary door 140.

In contrast, if the auxiliary door 140 is closed, the opening 133 may open so that laundry or washing water contained in the auxiliary washing space 130*a* may be discharged to the opening 133 by its own weight. The laundry or washing water discharged from the auxiliary washing space 130*a* may be contained in the main washing space 33 formed in the inside of the main body 10.

The auxiliary washing unit 130 may include a support flange 136 to support the auxiliary door 140 when the auxiliary door 140 is in a closed state. The support flange 136 may be disposed at edges of the auxiliary entrance 125.

The auxiliary door 140 may open or close the auxiliary entrance 125. The auxiliary door 140 may have the same shape as the auxiliary entrance 125. If the auxiliary door 140 is closed, the auxiliary door 140 may be accommodated in the auxiliary entrance 125.

The meaning that the auxiliary door 140 is accommodated in the auxiliary entrance 125 means that when the auxiliary door 140 is closed, the auxiliary door 140 enters the inside of the auxiliary entrance 125 to close the auxiliary entrance 125, not that the auxiliary door 140 closes the auxiliary entrance 125 outside the auxiliary entrance 125. At this time, the entire of the auxiliary door 140 may enter the inside of the auxiliary entrance 125 so that the upper end of the auxiliary door 140 does not protrude outward from the auxiliary entrance 125, or a part of the auxiliary door 140 may enter the inside of the auxiliary entrance 125.

According to another aspect, the auxiliary door 140 may have a smaller size than the main door 110, and when the auxiliary door 140 is closed, the auxiliary door 140 may cover only the auxiliary entrance 125 which is a part of the main door 110, without covering the entire of the main door 110.

Accordingly, both the main door 110 and the auxiliary door 140 may enable the user to see the inside of the washing machine 1 when the main door 110 and the auxiliary door 140 are closed, while reducing manufacturing cost of the door unit 100.

As described above, if the auxiliary door 140 opens, the auxiliary door 140 may close the opening 133. If the opening 133 is closed, water can be stored in the auxiliary washing space 130*a*, so that the user can hand-wash laundry with the water stored in the auxiliary washing space 130*a*.

That is, the auxiliary door 140 may rotate between a first position P1 (see FIG. 8) to close the auxiliary entrance 125 and open the opening 133 and a second position P2 (see FIG. 6) to open the auxiliary entrance 125 and close the opening 133.

The auxiliary door 140 may have a filler portion 142 (see FIG. 5) for closing the opening 133. When the auxiliary door 140 opens, the filler portion 142 may close the opening 133.

The filler portion 142 of the auxiliary door 140 may be located behind the auxiliary rotation shaft 141 of the auxiliary door 140. That is, the filler portion 142 may be positioned at the substantially same height as the rotation shaft 141 when the auxiliary door 140 is in a closed state, and when the auxiliary door 140 opens, the filler portion 142 may be positioned below the rotation shaft 141.

In the current embodiment, the filler portion 142 of the auxiliary door 140 may have the same shape as the opening 133. The filler portion 142 of the auxiliary door 140 may be accommodated in the opening 133.

However, the filler portion 142 of the auxiliary door 140 may have any other shape as long as it can close the opening 133. For example, the filler portion 142 of the auxiliary door 140 may have a larger size than the opening 133 in order to cover the opening 133.

If the auxiliary door 140 is closed after hand-washing terminates, the opening 133 may open so that laundry and washing water accommodated in the auxiliary washing space 130*a* can be discharged to the main washing space 33 of the main body 10 through the opening 133.

Accordingly, no operation for discharging laundry and washing water contained in the auxiliary washing space 130*a* to the main washing space 33 after hand-washing may be needed, and a series of operations for hand-washing can be simplified.

The door unit 100 may include a sealing member 150 to seal between the auxiliary door 140 and the opening 133 when the auxiliary door 140 is in an open state to prevent washing water from leaking out, a first locking apparatus 160 to fix the auxiliary door 140 when the auxiliary door 140 is in an open state such that the auxiliary door 140 can support a weight of washing water and laundry, and a second locking apparatus 170 to fix the auxiliary door 140 in a closed state when the main door 110 is opened and closed.

The main door 110 may include a locking apparatus accommodating portion 129 in which the second locking apparatus 170 is installed.

Figure 10:
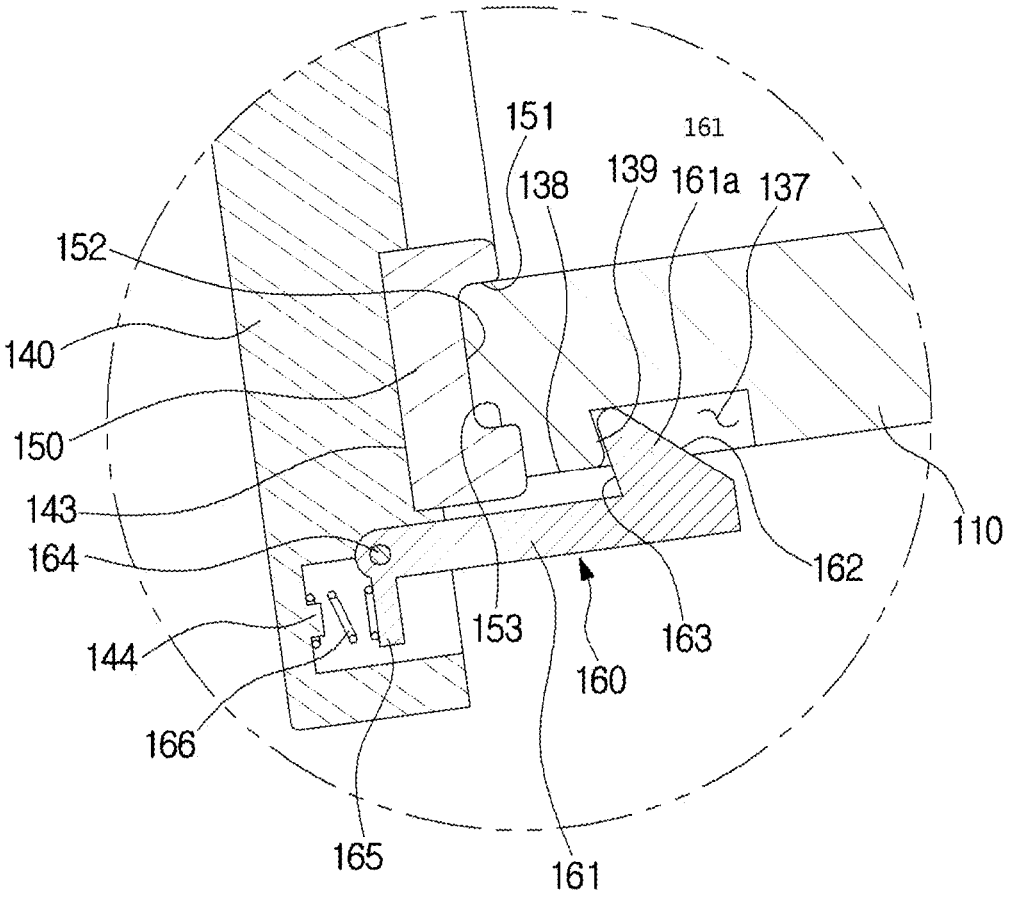
FIGS. 10 and 11 show a first locking unit of the washing machine of FIG. 1.
Figure 11:
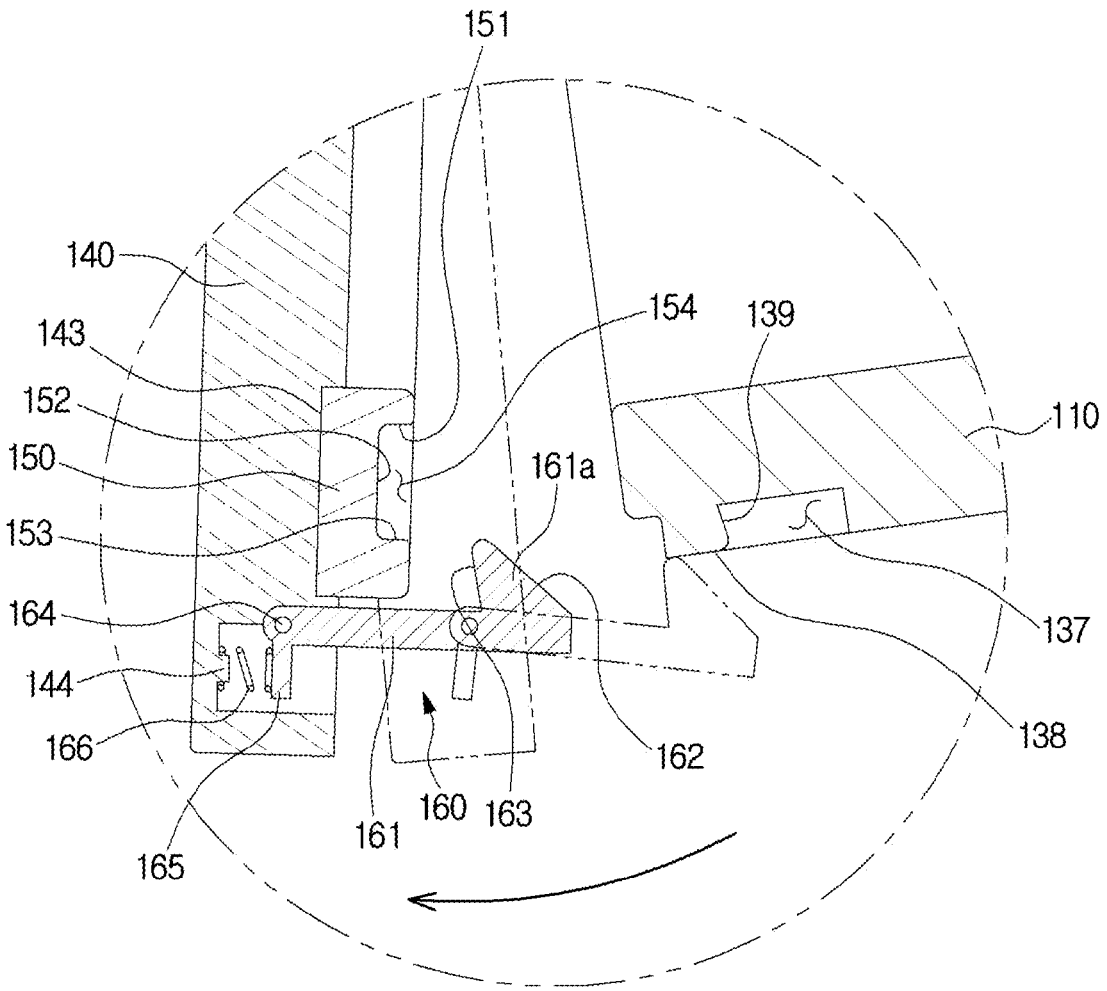

FIGS. 10 and 11 show a first locking unit of the washing machine of FIG. 1. FIGS. 12 to 15 show a second locking unit of the washing machine of FIG. 1.

Referring to FIGS. 10 to 15, the sealing member 150, the first locking apparatus 160, and the second locking apparatus 170 will be described below.

The sealing member 150 may seal between the auxiliary door 140 and the opening 133 when the auxiliary door 140 is in an open state, to prevent washing water from leaking out.

In the current embodiment, the sealing member 150 may be disposed in the auxiliary door 140, however, the sealing member 150 may be disposed in the main door 110.

In the auxiliary door 140, an installation groove 143 in which the sealing member 150 is installed may be formed. The installation groove 143 may be formed in the rear surface of the auxiliary door 140.

The sealing member 150 may be made of a rubber material. The sealing member 150 may have a sealing groove 154 (see FIG. 11) into which an end of the main door 110 is inserted, and a first sealing surface 151, a second sealing surface 152, and a third sealing surface 153 forming the sealing groove 154. Through the structure, the sealing member 150 may support the main door 110 on three surfaces to strengthen a sealing force.

The first locking apparatus 160 may fix the auxiliary door 140 in an open state. The first locking apparatus 160 may prevent the auxiliary door 140 from rotating due to a weight of washing water and laundry stored in the auxiliary washing space 130*a*.

The first locking apparatus 160 may include a hook member 161 rotatably connected to the auxiliary door 140 that is rotatable, and an elastic member 166 to elastically support the hook member 161.

The main door 110 may include a catching groove 137 interworking with the hook member 161.

However, unlike the current embodiment, the hook member 161 may be disposed in the main door 110, and the catching groove 137 may be disposed in the auxiliary door 140.

In an end 161*a* of the hook member 161, an inclined surface 162 to guide the hook member 161 to enter the catching groove 137 of the main door 110, and a hook surface 163 to fix the hook member 161 may be formed.

Around the catching groove 137 of the main door 110, a guide surface 138 may be formed to guide the end 161*a* of the hook member 161 to the catching groove 137, and in the inside of the catching groove 137, a catching surface 139 may be formed to catch the hook surface 163 of the hook member 161.

The hook member 161 may be rotatable on the rotation shaft 164. The hook member 161 may have an elastic member supporting portion 165 on which one end of the elastic member 166 is supported. In the auxiliary door 140, an elastic member installing portion 144 on which the other end of the elastic member 166 is supported may be disposed.

The elastic member 166 may elastically bias the hook member 161 in a direction in which the end 161*a* of the hook member 161 is inserted into the catching groove 137.

Through the structure, when the auxiliary door 140 opens, the hook member 161 may rotate a little in a direction in which the end 161*a* of the hook member 161 is widened from the auxiliary door 140, so that the end 161*a* of the hook member 161 is inserted into the catching groove 137 of the main door 110, and the hook surface 163 of the hook member 161 is caught by the catching surface 139 of the main door 110, thereby fixing the auxiliary door 140.

As shown in FIG. 11, if a user presses the auxiliary door 140 with a greater force than an elastic force of the elastic member 166 when the auxiliary door 140 is in a fixed state, the hook member 161 may be released so that the auxiliary door 140 can rotate.

The second locking apparatus 170 may fix the auxiliary door 140 in a closed state. Accordingly, the auxiliary door 140 can move together with the main door 110 while being fixed on the main door 110, regardless of opening/closing operation of the main door 110.

If the auxiliary door 140 is pushed with a predetermined force when the auxiliary door 140 is in a closed state, the second locking apparatus 170 may be unlocked. The function can be implemented through various structures.

Figure 12:
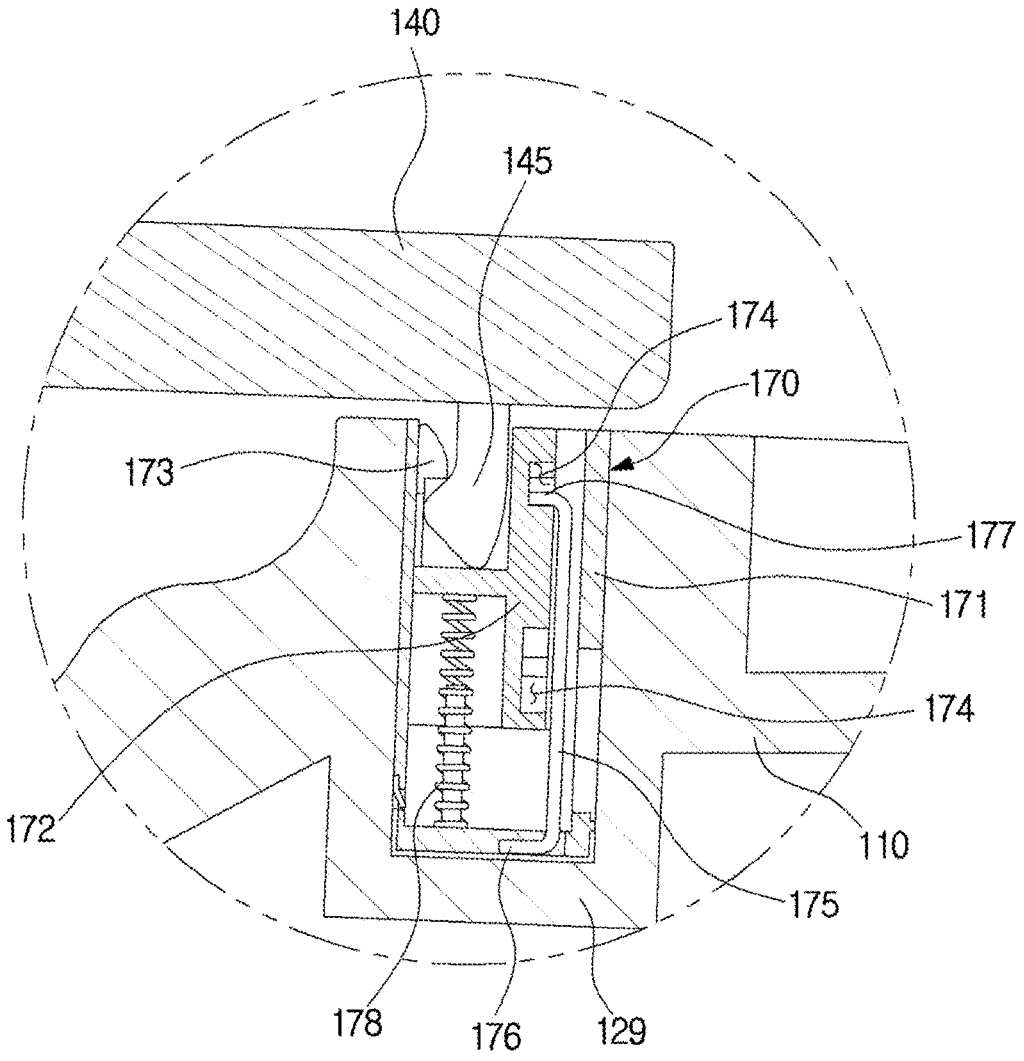
FIGS. 12 to 15 show a second locking unit of the washing machine of FIG. 1.
Figure 13:
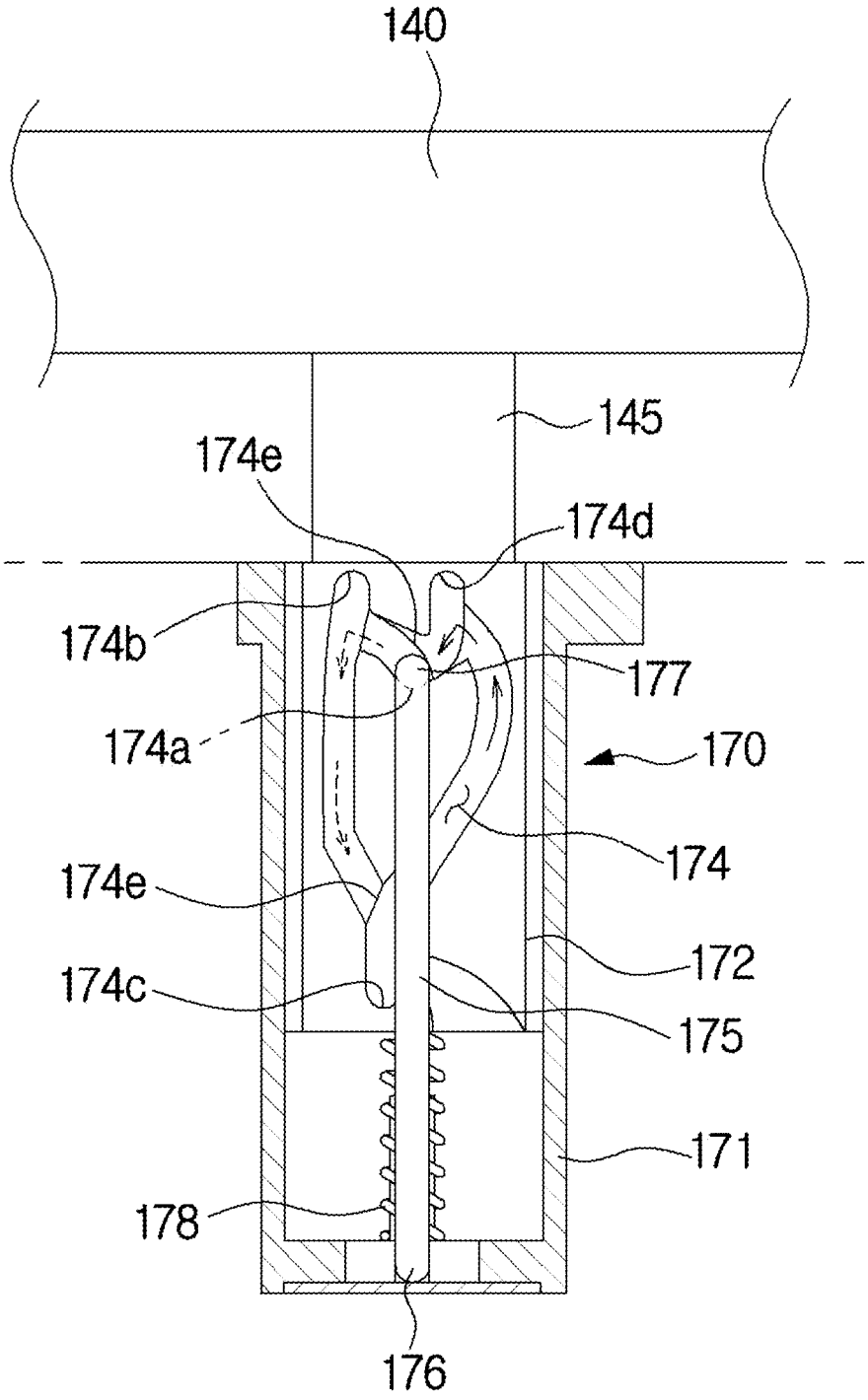
Figure 14:
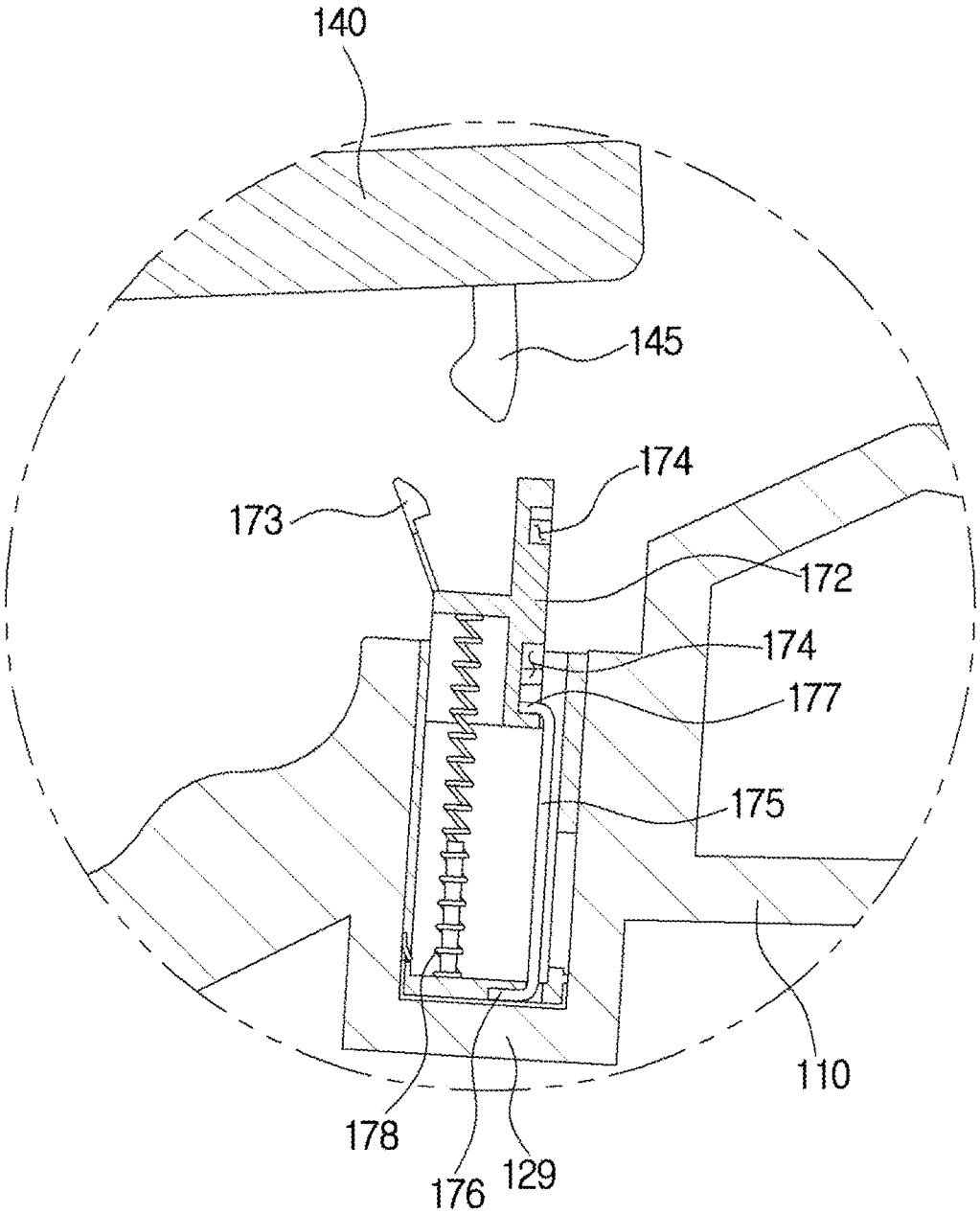

For example, as shown in FIGS. 12 to 14, the second locking apparatus 170 may include a housing 171, a sliding bar 172 configured to move forward or backward in the inside of the housing 171, a moving bar 175 having a free end 177 moving along a guide groove 174 formed in one end of the sliding bar 172 and a support end 176 supported on one side of the housing 171, and an elastic member 178 to elastically support the sliding bar 172.

In the sliding bar 172, an elastic hook 173 which is interfered by a locking protrusion 145 of the auxiliary door 140, and elastically biased in a direction which is widened from the locking protrusion 145 may be disposed.

The guide groove 174 may guide the free end 177 of the moving bar 175.

The guide groove 174 may include a locking groove 174*a* to lock the auxiliary door 140, a first stopping groove 174*b* and a second stopping groove 174*d* to limit a moving distance of the free end 177 of the moving bar 175, an unlocking groove 174*c* to unlock the auxiliary door 140, and a step portion 174*e* to prevent the free end 177 of the moving bar 175 from moving reversely.

As shown in FIGS. 12 and 13, if the locking protrusion 145 of the auxiliary door 140 presses the sliding bar 172 of the second locking apparatus 170 when the auxiliary door 140 is closed, the sliding bar 172 may enter the inside of the housing 171 so that the elastic hook 173 of the sliding bar 172 is interfered by the locking protrusion 145 to fix the auxiliary door 140. At this time, the elastic member 178 may accumulate an elastic force.

At this time, the free end 177 of the moving bar 175 may move in a direction of solid lines of FIG. 13 in the guide groove 174. That is, the free end 177 of the moving bar 175 may move from the unlocking groove 174*c* to the second stopping groove 174*d*, and then move backward to be finally rested on the locking groove 174*a*. If the free end 177 of the moving bar 175 is rested on the locking groove 174*a*, the auxiliary door 140 can be more stably fixed.

Figure 15:
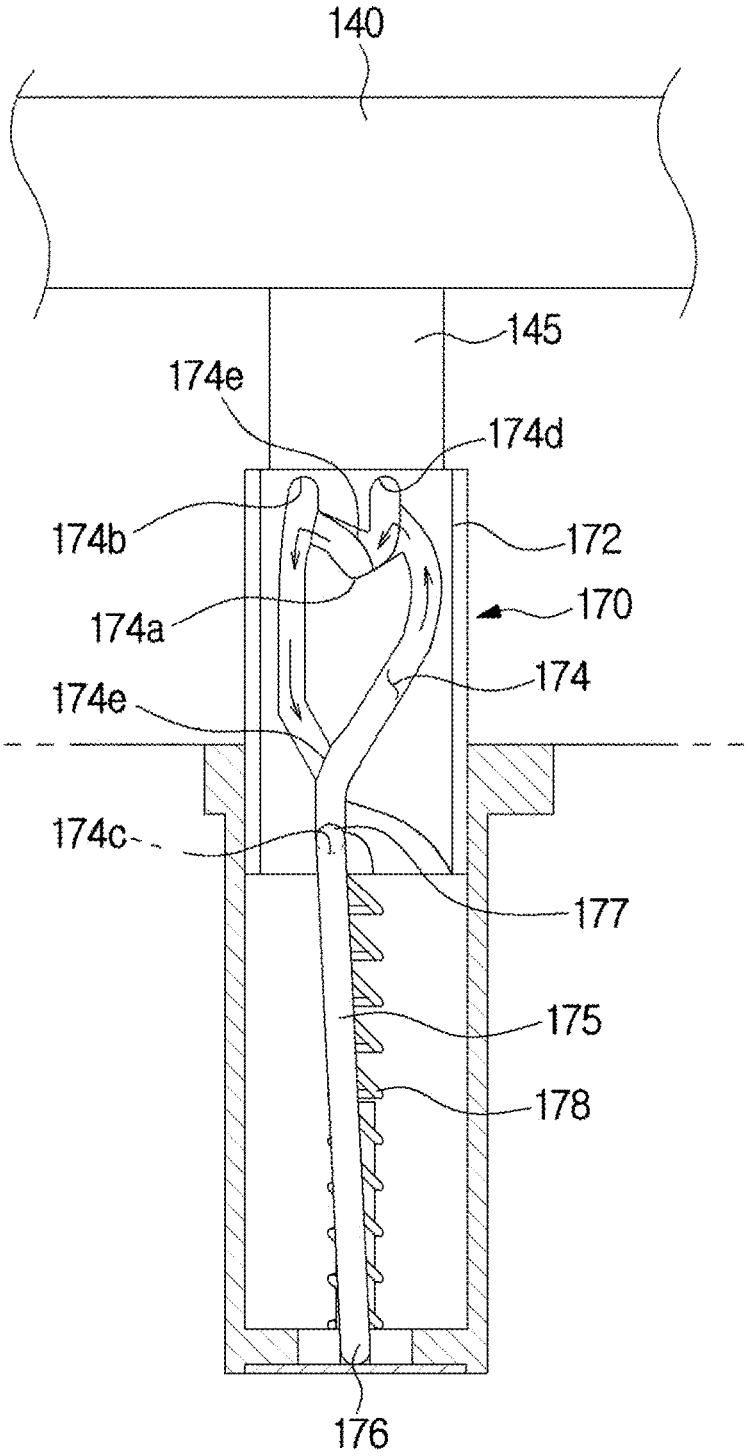

As shown in FIGS. 14 and 15, if a user pushes the auxiliary door 140, the sliding bar 172 may bounce off the housing 171 by the elastic force accumulated in the elastic member 178 so that the interference between the locking protrusion 145 of the auxiliary door 140 and the elastic hook 173 of the sliding bar 172 is released, thereby unlocking the auxiliary door 140.

At this time, the free end 177 of the moving bar 175 may move from the locking groove 174*a* to the first stopping groove 174*b* and then move backward to be finally rested on the unlocking groove 174*c*, as represented by left solid lines of FIG. 15.

Figure 16:
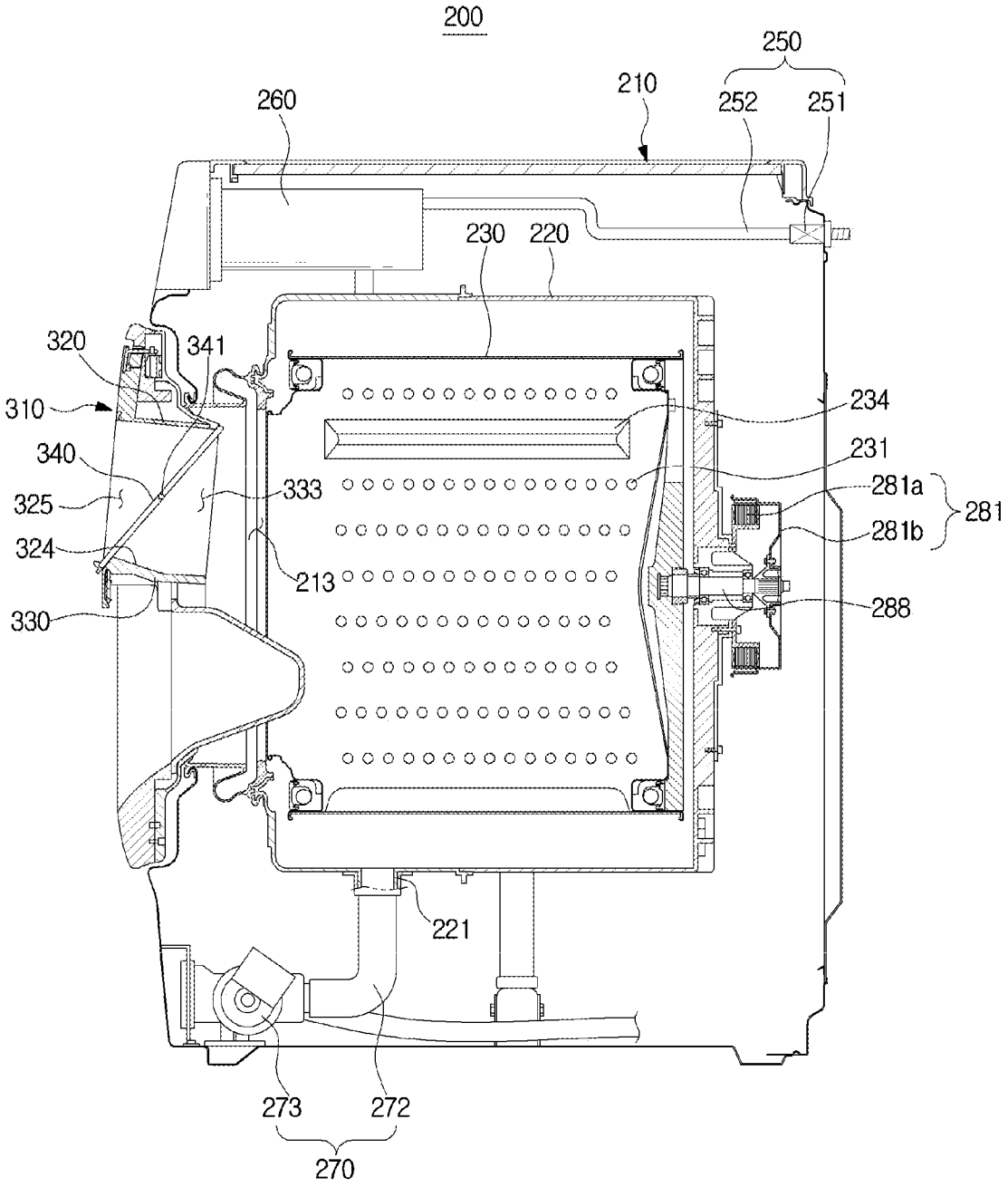
FIGS. 16 and 17 are schematic cross-sectional views of a washing machine according to another embodiment of the present disclosure.
Figure 17:
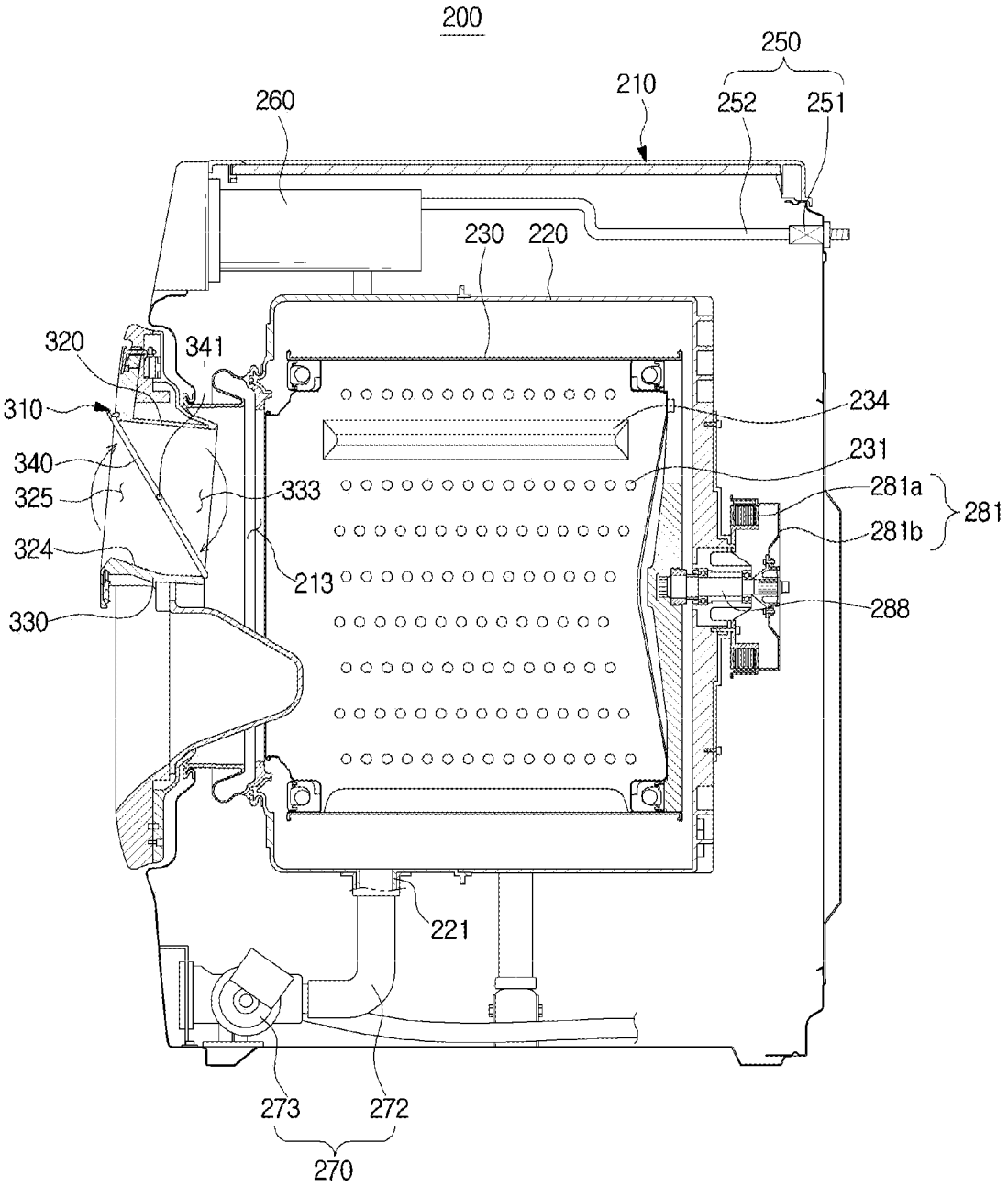

FIGS. 16 and 17 are schematic cross-sectional views of a washing machine according to another embodiment of the present disclosure.

Hereinafter, the washing machine according to another embodiment of the present disclosure will be described with reference to FIGS. 16 and 17. In the following description, the same components as those of the above-described embodiment will be assigned the same reference numerals, and detailed descriptions thereof will be omitted.

The washing machine according to the above-described embodiment is a top loading type washing machine having a pulsator, however, the technical concepts of the present disclosure can be applied to a front loading type washing machine having a drum.

A washing machine 200 may include a main body 210, and a main washing unit installed in the inside of the main body 210. The main washing unit may include a tub 220 to store washing water, and a drum 230 rotatably disposed in the inside of the tub 220 to accommodate laundry.

The main body 210 may be in the shape of a box, and include a main entrance 13 through which laundry can be put, in the front portion.

The tub 220 may be in the shape of a cylinder whose front portion opens. In a bottom of the tub 220, a drain 221 may be disposed to discharge washing water stored in the tub 220 to the outside of the main body 210.

The drum 230 may be rotatably disposed in the inside of the tub 220 to accommodate laundry. The drum 230 may be in the shape of a cylinder whose front portion opens, and have a plurality of through holes 231 to pass washing water through.

On an inner circumferential surface of the drum 230, a lifter 234 may be disposed to lift laundry. Accordingly, laundry can be washed by impacts generated when the drum 230 rotates to lift and drop the laundry.

The washing machine 200 may include a water-supply apparatus 250. The water-supply apparatus 250 may include a water-supply valve 251 to control supply of water, and a water-supply pipe 252 to guide washing water. The water-supply pipe 252 may be connected to a detergent supply apparatus 260.

The washing machine 200 may include a drain apparatus 270 to discharge washing water in the inside of the tub 220 to the outside of the main body 210. The drain apparatus 270 may include a drain pump 273 and a drain pipe 272 connected to the drain 221 of the tub 220.

The washing machine 200 may include a driving apparatus 80 for rotating the drum 230. The driving apparatus 80 may include a motor 281 to generate a driving force, and a rotation shaft 288 to transfer the driving force of the motor 281 to the drum 230. The motor 281 may be configured with a stator 281*a* that is fixed, and a rotor 281*b* rotating by electromagnetically interacting with the stator 281*a*.

The washing machine 200 may include a door unit 100 to open or close the main entrance 13 of the main body 210.

The door unit 100 may be rotatably hinge-coupled with the main body 210.

The door unit 100 may include a main door 310 and an auxiliary door 340.

The auxiliary door 340 may be coupled with the main door 310 to be rotatable on a rotation shaft 341.

The main door 310 may include a body unit 320, an auxiliary washing unit 330, an auxiliary entrance 325, and an opening 333. The auxiliary washing unit 330 may be disposed below the body unit 320.

The auxiliary entrance 325 may be disposed in front of the auxiliary washing unit 330 or on the upper surface of the auxiliary washing unit 330. A user may put laundry into the auxiliary washing unit 330 through the auxiliary entrance 325, or put his/her hands into the auxiliary washing unit 330 through the auxiliary entrance 325 to hand-wash the laundry.

The opening 333 may be formed behind the auxiliary washing unit 330. The opening 333 may discharge laundry and washing water to the drum 230 in the inside of the main body 210. The bottom 324 of the auxiliary washing unit 330 may be inclined downward toward the opening 333.

Accordingly, laundry or washing water contained in an auxiliary washing space may be discharged to the opening 333 by its own weight. The laundry or washing water discharged from the auxiliary washing space may be contained in the drum 230 as a main washing space formed in the inside of the main body 210.

The auxiliary door 340 may open or close the auxiliary entrance 325. Also, the auxiliary door 340 may close the opening 333.

That is, the auxiliary door 340 may rotate between a first position (see FIG. 15) to close the auxiliary entrance 325 and open the opening 333 and a second position (see FIG. 17) to open the auxiliary entrance 325 and close the opening 333.

If the auxiliary door 340 opens as shown in FIG. 17, the auxiliary door 340 may close the opening 333 of the main door 310 to form the auxiliary washing space in which washing water can be contained.

If the auxiliary door 340 is closed as shown in FIG. 16, the opening 333 of the main door 310 may open so that washing water and laundry contained in the auxiliary washing space can be discharged to the main washing space in the inside of the main body 210.

In addition to the above-described components, other components of the above-described embodiment, such as the sealing member 150, the first locking apparatus 160, and the second locking apparatus 170, can also be applied to the front loading type washing machine.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. A washing machine comprising:

a main body;

a main washing unit disposed in the inside of the main body; and a door unit configured to open or close a main entrance formed in the main body to communicate with the main washing unit, wherein the door unit comprises:

a main door having a body unit formed with an auxiliary entrance, an auxiliary washing unit formed to be recessed from the body unit and having an opening, and an auxiliary door rotatably coupled with the main door and including an auxiliary rotation shaft, wherein the auxiliary door is configured to rotate about the auxiliary rotation shaft between a first position, to close the auxiliary entrance and open the opening, and a second position, to open the auxiliary entrance and close the opening, wherein if the auxiliary door opens, the auxiliary door is further configured to close the opening to form an auxiliary washing space in which water is able to be contained.

2. The washing machine according to claim 1, wherein if the auxiliary door is closed, the opening is configured to open in a manner that the water contained in the auxiliary washing space is discharged to the main washing unit through the opening.

3. The washing machine according to claim 1, wherein the auxiliary door includes a filler portion configured to close the opening.

4. The washing machine according to claim 3, wherein the filler portion is located behind the auxiliary rotation shaft of the auxiliary door.

5. The washing machine according to claim 1, wherein the opening is disposed behind the auxiliary washing unit.

6. The washing machine according to claim 1, wherein the auxiliary entrance and the opening are located on different planes.

7. The washing machine according to claim 1, wherein the auxiliary door is accommodated in the auxiliary entrance when the auxiliary door is in a closed state.

8. The washing machine according to claim 1, wherein the door unit includes a sealing member configured to seal between the auxiliary door and the opening when the auxiliary door is in an open state.

9. The washing machine according to claim 8, wherein the sealing member is disposed in the auxiliary door.

10. The washing machine according to claim 1, wherein the door unit includes an open state locking apparatus configured to fix the auxiliary door when the auxiliary door is in an open state.

11. The washing machine according to claim 10, wherein the open state locking apparatus includes:

a hook member configured to be rotatable, and an elastic member configured to elastically support the hook member.

12. The washing machine according to claim 1, wherein the door unit includes a closed state locking apparatus configured to fix the auxiliary door when the auxiliary door is in a closed state.

13. The washing machine according to claim 12, wherein if the auxiliary door is pushed, the closed state locking apparatus is unlocked.

14. The washing machine according to claim 1, wherein the main door includes a support flange disposed at edges of the auxiliary entrance, and configured to support the auxiliary door when the auxiliary door is in a closed state.

* * * * *